US010032426B2

(12) United States Patent
Kim et al.

(10) Patent No.: US 10,032,426 B2
(45) Date of Patent: Jul. 24, 2018

(54) DISPLAY APPARATUS AND METHOD OF DRIVING THE SAME

(71) Applicant: SAMSUNG DISPLAY CO., LTD., Yongin-si, Gyeonggi-do (KR)

(72) Inventors: Gi Geun Kim, Seoul (KR); Nam-Gon Choi, Yongin-si (KR); Bong-Gyun Kang, Suwon-si (KR); Jae-Sung Bae, Suwon-si (KR); Dong Hwa Shin, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 148 days.

(21) Appl. No.: 15/092,815

(22) Filed: Apr. 7, 2016

(65) Prior Publication Data

US 2017/0084249 A1 Mar. 23, 2017

(30) Foreign Application Priority Data

Sep. 22, 2015 (KR) ..... 10-2015-0133849

(51) Int. Cl.

| | |
|---|---|
| ***G09G 5/10*** | (2006.01) |
| ***G09G 3/36*** | (2006.01) |
| *G09G 5/00* | (2006.01) |

(52) U.S. Cl.

CPC ..... *G09G 3/3688* (2013.01); *G09G 5/10* (2013.01); *G09G 3/3607* (2013.01); *G09G 3/3611* (2013.01); *G09G 5/006* (2013.01); *G09G 2300/0447* (2013.01); *G09G 2320/0673* (2013.01)

(58) Field of Classification Search

None

See application file for complete search history.

(56) References Cited

U.S. PATENT DOCUMENTS

2010/0007680 A1* 1/2010 Yu ..... G09G 3/2003 345/690
2013/0321483 A1* 12/2013 You ..... G09G 5/10 345/690
2015/0145898 A1* 5/2015 Hwang ..... G09G 3/3688 345/690

FOREIGN PATENT DOCUMENTS

KR 1020100007077 1/2010
KR 1020130134567 12/2013

* cited by examiner

*Primary Examiner* — Stephen T Reed
(74) *Attorney, Agent, or Firm* — F. Chau & Associates, LLC

(57) ABSTRACT

A display apparatus includes a gamma data generator comprising a spatial pattern having at least a high gamma and a low gamma corresponding to a plurality of sub-pixels arranged in a matrix array in a space division configuration, a temporal pattern having the high gamma and the low gamma corresponding to the plurality of sub-pixels in a time division configuration and a spatio-temporal pattern having the high gamma and the low gamma corresponding to the plurality of sub-pixels in both a space and time division configuration, and configured to generate gamma data of a sub-pixel using the spatial pattern, the temporal pattern and the spatio-temporal pattern in a cascade configuration.

19 Claims, 12 Drawing Sheets

FIG. 7

| | HIGH GAMMA LUT | LOW GAMMA LUT |
|---|---|---|
| 0G | 0G | 0G |
| ⋮ | ⋮ | ⋮ |
| 10G | 80G | 0G |
| ⋮ | ⋮ | ⋮ |
| 170G | 230G | 10G |
| ⋮ | ⋮ | ⋮ |
| 230G | 255G | 160G |
| ⋮ | ⋮ | ⋮ |
| 255G | 255G | 255G |

<DOT PATTERN>

DISPLAY APPARATUS AND METHOD OF DRIVING THE SAME

CROSS-REFERENCE TO RELATED APPLICATION

This application claims priority under 35 U.S.C. § 119 from and the benefit of Korean Patent Application No. 10-2015-0133849 filed on Sep. 22, 2015, which is hereby incorporated by reference for all purposes as if fully set forth herein.

FIELD

Exemplary embodiments of the inventive concept relate to a display apparatus and a method of driving the display apparatus. More particularly, exemplary embodiments of the inventive concept relate to a display apparatus and a method of driving the display apparatus for high display quality.

DISCUSSION OF RELATED ART

A liquid crystal display (LCD) panel may include a thin film transistor (TFT) substrate, an opposing substrate and a liquid crystal (LC) layer disposed between the two substrates. The TFT substrate may include a plurality of gate lines, a plurality of data lines crossing the gate lines, a plurality of TFTs connected to the gate lines and the data lines, and a plurality of pixel electrodes connected to the TFTs. A TFT may include a gate electrode extended from a gate line, a source electrode extended to a data line, and a drain electrode spaced apart from the source electrode.

The LCD panel may not emit light by itself. In other words, it is not self-emissive. The LCD panel may receive light from the backside of the LCD panel or from the front of the LCD panel. The LCD panel may have limited side visibility.

SUMMARY

Exemplary embodiments of the inventive concept provide a display apparatus with high side visibility and a method of driving the display apparatus. A multi-domain technique may be used.

According to an exemplary embodiment of the inventive concept, there is provided a display apparatus. The display apparatus includes a display panel comprising a data line, a gate line crossing the data line and a sub-pixel connected to the data line and the gate line, a gamma data generator comprising a spatial pattern having a high gamma and a low gamma corresponding to a plurality of sub-pixels arranged in an (n×m) matrix array in a space division method (where 'n' and 'm' are natural numbers), a temporal pattern having the high gamma and the low gamma corresponding to the plurality of sub-pixels in a time division method and a spatio-temporal pattern having the high gamma and the low gamma corresponding to the plurality of sub-pixels in both space division method and time division method, and to generate gamma data of a sub-pixel using the spatial pattern, the temporal pattern and the spatio-temporal pattern in a cascade method, and a data driver configured to convert the gamma data to a data voltage and to output the data voltage to the data line.

In an exemplary embodiment, at least one of the patterns further includes at least a third gamma corresponding to the plurality of sub-pixels.

In an exemplary embodiment, the gamma data generator may include a high gamma look-up table (LUT) configured to store high gamma data corresponding to grayscales based on the high gamma, a low gamma LUT configured to store low gamma data corresponding to the grayscales based on the low gamma, a first gamma controller configured to generate first gamma data of the sub-pixel being high gamma data or low gamma data corresponding to the image data of the sub-pixel based on a first preset pattern which is preset to one among the spatial, temporal and spatio-temporal patterns to the image data of the sub-pixel, and a second gamma controller configured to generate second gamma data of the sub-pixel being high gamma data or low gamma data corresponding to the first gamma data of the sub-pixel based on a second preset pattern which is preset to one among the spatial, temporal and spatio-temporal patterns.

In an exemplary embodiment, the gamma data generator may further include at least a third gamma controller configured to generate at least third gamma data for the sub-pixel corresponding to the first and second gamma data of the sub-pixel based on at least a third preset to one among a spatial, temporal or spatio-temporal pattern.

In an exemplary embodiment, the second gamma data of the sub-pixel may include first mixing gamma data, second mixing gamma data, third mixing gamma data and fourth mixing gamma data, the first mixing gamma data may be generated using the high gamma LUT of the first preset pattern and the high gamma LUT of the second preset pattern in the cascade method, the second mixing gamma data may be generated using the high gamma LUT of the first preset pattern and the low gamma LUT of the second preset pattern in the cascade method, the third mixing gamma data may be generated using the low gamma LUT of the first preset pattern and the high gamma LUT of the second preset pattern in the cascade method, and the fourth mixing gamma data may be generated using the low gamma LUT of the first preset pattern and the low gamma LUT of the second preset pattern in the cascade method.

In an exemplary embodiment, a number of mixing conditions of the first preset pattern and second preset pattern may be at least 9.

In an exemplary embodiment, the temporal pattern, the spatial pattern and the spatio-temporal pattern may respectively correspond to a plurality of sub-pixels arranged in a (2×2) matrix array.

In an exemplary embodiment, the display apparatus may further include a pattern detector configured to detect an image pattern of the image data, and to determine the first preset pattern and the second preset pattern corresponding to the image pattern.

In an exemplary embodiment, the sub-pixel may include a plurality of sub-areas and each of the plurality of sub-areas is individually driven.

According to an exemplary embodiment of the inventive concept, there is provided a method of driving a display apparatus which includes a data line, a gate line crossing the data line and a sub-pixel connected to the data line and the gate line. The method may include generating gamma data of a sub-pixel using a spatial pattern, a temporal pattern and a spatio-temporal pattern in a cascade method, the spatial pattern having a high gamma and a low gamma corresponding to a plurality of sub-pixels arranged in an (n×m) matrix array in a space division method (where 'n' and 'm' are natural numbers), the temporal pattern having the high gamma and the low gamma corresponding to the plurality of sub-pixels in a time division method and the spatio-temporal pattern having the high gamma and the low gamma corresponding to the plurality of sub-pixels in both space division method and time division method, and converting the gamma data to a data voltage to output the data voltage to the data line.

In an exemplary embodiment, at least one of the patterns may further include at least a third gamma corresponding to the plurality of sub-pixels.

In an exemplary embodiment, the method may further include generating first gamma data of the sub-pixel being high gamma data or low gamma data corresponding to the image data of the sub-pixel based on a first preset pattern which is preset to one among the spatial, temporal and spatio-temporal patterns, and generating second gamma data of the sub-pixel being high gamma data or low gamma data corresponding to the first gamma data of the sub-pixel based on a second preset pattern which is preset to one among the spatial, temporal and spatio-temporal patterns to the first gamma data of the sub-pixel.

In an exemplary embodiment, the method may further include generating third gamma data for the sub-pixel corresponding to the first and second gamma data of the sub-pixel based on a third preset pattern that is preset to one among spatial, temporal or spatio-temporal patterns.

In an exemplary embodiment, the method may further include generating gamma data of the sub-pixel using a high gamma look-up table (LUT) which is configured to store high gamma data corresponding to grayscales based on the high gamma and a low gamma LUT which is configured to store low gamma data corresponding to the grayscales based on the low gamma.

In an exemplary embodiment, the second gamma data of the sub-pixel may include first mixing gamma data, second mixing gamma data, third mixing gamma data and fourth mixing gamma data, the first mixing gamma data may be generated using the high gamma LUT of the first preset pattern and the high gamma LUT of the second preset pattern in the cascade method, the second mixing gamma data may be generated using the high gamma LUT of the first preset pattern and the low gamma LUT of the second preset pattern in the cascade method, the third mixing gamma data may be generated using the low gamma LUT of the first preset pattern and the high gamma LUT of the second preset pattern in the cascade method, and the fourth mixing gamma data may be generated using the low gamma LUT of the first preset pattern and the low gamma LUT of the second preset pattern in the cascade method.

In an exemplary embodiment, a number of mixing conditions of the first preset pattern and second preset pattern may be at least 9.

In an exemplary embodiment, the temporal pattern, the spatial pattern and the spatio-temporal pattern may respectively correspond to a plurality of sub-pixels arranged in a (2×2) matrix array.

In an exemplary embodiment, the method may further include detecting an image pattern of the image data, and determining the first preset pattern and the second preset pattern corresponding to the image pattern.

In an exemplary embodiment, the sub-pixel may include a plurality of sub-areas and each of the plurality of sub-areas is individually driven.

According to the inventive concept, multi gammas may be designed using both high and low gammas and thus, side visibility may be high.

BRIEF DESCRIPTION OF THE DRAWINGS

The above and other features of the inventive concept will become more apparent by describing in detail exemplary embodiments thereof with reference to the accompanying drawings, in which:

FIG. 7 is a tabular diagram illustrating high and low gamma look-up tables according to an exemplary embodiment;

DETAILED DESCRIPTION

Hereinafter, the inventive concept will be explained in detail with reference to the accompanying drawings.

Figure 1:
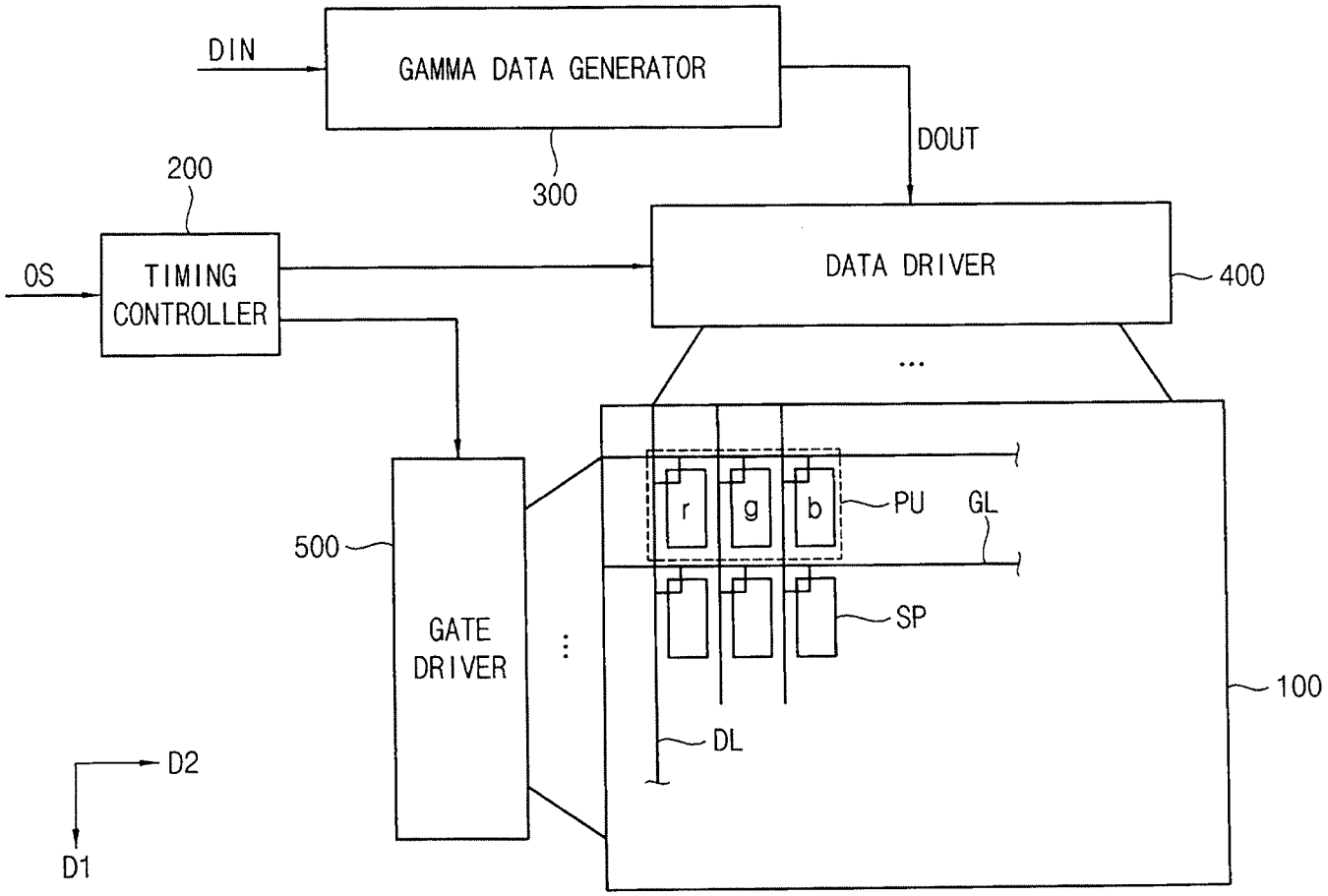
FIG. 1 is a block diagram illustrating a display apparatus according to an exemplary embodiment.

FIG. 1 is a block diagram illustrating a display apparatus according to an exemplary embodiment.

Referring to FIG. 1, the display apparatus may include a display panel 100, a timing controller 200, a gamma data generator 300, a data driver 400 connected between the gamma data generator and the display panel and between the timing controller and the display panel, and a gate driver 500 connected between the timing controller and the display panel.

The display panel 100 may include a plurality of data lines DL connected to the data driver, a plurality of gate lines GL connected to the gate driver, and a plurality of pixel units PU each connected between one of the plurality of data lines and one of the plurality of gate lines. The data lines DL extend in a first direction D1 and are arranged in a second direction D2 crossing the first direction D1. The gate lines GL extend in the second direction D2 and are arranged in the first direction D1. The pixel units PU are arranged as a matrix array which includes a plurality of pixel rows and a plurality of pixel columns. Each of the pixel units PU may include a plurality of sub-pixels SP. For example, the pixel unit PU includes a red sub-pixel r, a green sub-pixel g and a blue sub-pixel b.

The timing controller 200 generally controls an operation of the display apparatus. The timing controller 200 is configured to receive an original synch signal OS, and to generate a plurality of control signals for driving the display panel 100 based on the original synch signal OS. The control signals may include a data control signal DCS for controlling the data driver 400 and a gate control signal GCS for controlling the gate driver 500.

The data control signal DCS may include a horizontal synch signal, a vertical synch signal, a data enable signal, a polarity control signal and the like. The gate control signal GCS may include a vertical start signal, a gate clock signal, an output enable signal and the like.

The gamma data generator 300 includes a spatial pattern, a temporal pattern and a spatio-temporal pattern corresponding to a plurality of sub-pixels arranged in an (n×m) matrix array and is configured to generate gamma data of a sub-pixel using the spatial pattern, the temporal pattern and the spatio-temporal pattern in a cascade method The spatial pattern has a high gamma H and a low gamma L corresponding to the sub-pixels arranged as the (n×m) matrix array in a space division method. According to the spatial pattern, during a same frame, the high gamma H may be applied to a first sub-pixel among the sub-pixels arranged as the (n×m) matrix array and the low gamma L may be applied to a second sub-pixel among the sub-pixels arranged as the (n×m) matrix array The temporal pattern has the high gamma H and the low gamma L corresponding to the sub-pixels arranged as the (n×m) matrix array in a time division method. According to the temporal pattern, when the high gamma H is applied to a sub-pixel among the sub-pixels arranged as the (n×m) matrix array during a first frame, the low gamma L may be applied to the sub-pixel during a second frame which is a next frame of the first frame.

The spatio-temporal pattern has the high gamma H and the low gamma L corresponding to the sub-pixels arranged as the (n×m) matrix array in both the space division method and the time division method. According to the spatio-temporal pattern, when the high gamma H is applied to a first sub-pixel among the sub-pixels arranged as the (n×m) matrix array and the low gamma L is applied to a second sub-pixel among the sub-pixels arranged as the (n×m) matrix array during a first frame, and the low gamma L may be applied to the first sub-pixel and the high gamma H is applied to the second sub-pixel during a second frame which is a next frame of the first frame.

The data driver 400 is configured to convert the gamma data DOUT received from the gamma data generator 300 into a data voltage for driving the sub-pixel of the display panel 100 and to output the data voltage to the data line DL.

The gate driver 500 is configured to generate a plurality of gate signals and to sequentially output the gate signals to the gate lines GL of the display panel 100.

Figure 2:
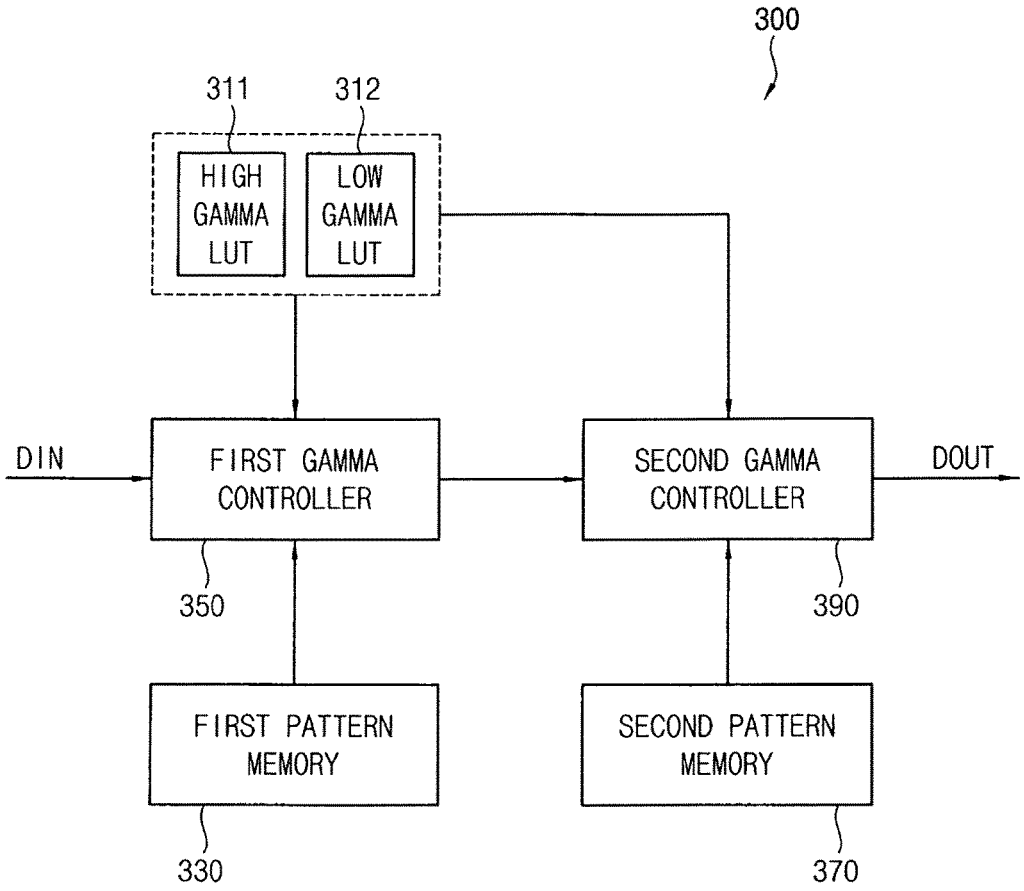
FIG. 2 is a block diagram illustrating a gamma data generator of FIG. 1.
Figure 3:
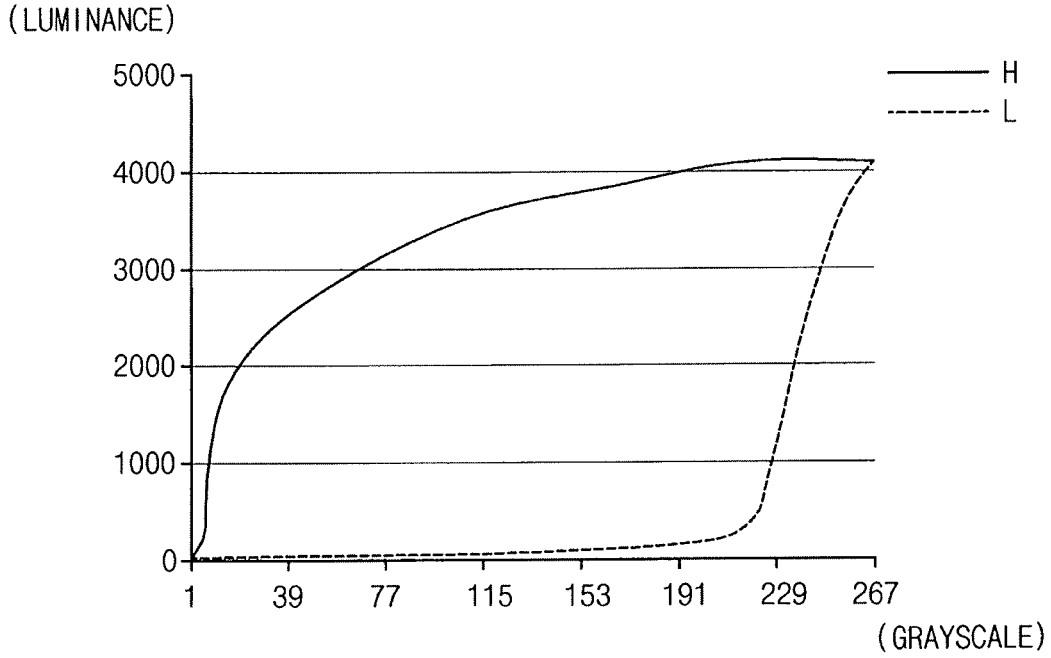
FIG. 3 is a graphical diagram illustrating high and low gammas of FIG. 2.

FIG. 2 is a block diagram illustrating a gamma data generator of FIG. 1. FIG. 3 is a diagram illustrating high and low gammas of FIG. 2.

Referring to FIGS. 1 and 2, the gamma data generator 300 may include a high gamma look-up table (LUT) 311, a low gamma LUT 312, a first pattern memory 330, a first gamma controller 350 connected to an image data input DIN and the first pattern memory and the LUTs, a second pattern memory 370, and a second gamma controller 390 connected to the first gamma controller and the second pattern memory and the LUTs and providing image data output DOUT.

The high gamma LUT 311 is configured to store high gamma data corresponding to grayscales based on the high gamma H as shown in FIG. 3.

The low gamma LUT is configured to store low gamma data corresponding to the grayscales based on the low gamma L as shown in FIG. 3.

The first pattern memory 330 is configured to store a spatial pattern, a temporal pattern and a spatio-temporal pattern.

The first gamma controller 350 is configured to generate first gamma data of the sub-pixel being high gamma data or low gamma data corresponding to the image data of the sub-pixel based on a first preset pattern which is preset to one among the spatial, temporal and spatio-temporal patterns.

The second pattern memory 370 is configured to store a spatial pattern, a temporal pattern and a spatio-temporal pattern.

The second gamma controller 390 is configured to generate second gamma data of the sub-pixel being high gamma data or low gamma data corresponding to the first gamma data of the sub-pixel based on a second preset pattern which is preset to one among the spatial, temporal and spatio-temporal patterns to the first gamma data of the sub-pixel.

For example, if the first preset pattern has the high gamma H corresponding to a sub-pixel and the second preset pattern has the high gamma H corresponding to the sub-pixel, the first gamma controller 350 is configured to output high gamma data corresponding to image data of the sub-pixel as first gamma data of the sub-pixel using the high gamma LUT and then, the second gamma controller 390 is configured to output high gamma data corresponding to the first gamma data of the sub-pixel as second gamma data of the sub-pixel using the high gamma LUT. Thus, the gamma data generator 300 may output first mixing gamma data HH corresponding to the image data of the sub-pixel by a high/high mixing gamma which is mixed from the high gammas H and H of the first and second preset patterns in the cascade method.

If the first preset pattern has the high gamma H corresponding to a sub-pixel and the second preset pattern has the low gamma L corresponding to the sub-pixel, the first gamma controller 350 is configured to output high gamma data corresponding to image data of the sub-pixel as first gamma data of the sub-pixel using the high gamma LUT and then, the second gamma controller 390 is configured to output low gamma data corresponding to the first gamma data of the sub-pixel as second gamma data of the sub-pixel using the low gamma LUT. Thus, the gamma data generator 300 may output second mixing gamma data HL corresponding to the image data of the sub-pixel by a high/low mixing gamma which is mixed from the high gamma H of the first preset pattern and the low gamma L of the second preset pattern in the cascade method.

If the first preset pattern has the low gamma L corresponding to a sub-pixel and the second preset pattern has the high gamma H corresponding to the sub-pixel, the first gamma controller 350 is configured to output low gamma data corresponding to image data of the sub-pixel as first gamma data of the sub-pixel using the low gamma LUT and then, the second gamma controller 390 is configured to output high gamma data corresponding to the first gamma data of the sub-pixel as second gamma data of the sub-pixel using the high gamma LUT. Thus, the gamma data generator 300 may output third mixing gamma data LH corresponding to the image data of the sub-pixel by a low/high mixing gamma which is mixed from the low gamma L of the first preset pattern and the high gamma H of the second preset pattern in the cascade method.

If the first preset pattern has the low gamma L corresponding to a sub-pixel and the second preset pattern has the low gamma L corresponding to the sub-pixel, the first gamma controller 350 is configured to output low gamma data corresponding to image data of the sub-pixel as first gamma data of the sub-pixel using the low gamma LUT and then, the second gamma controller 390 is configured to output low gamma data corresponding to the first gamma data of the sub-pixel as second gamma data of the sub-pixel using the low gamma LUT. Thus, the gamma data generator 300 may output fourth mixing gamma data LL corresponding to the image data of the sub-pixel by a low/low mixing gamma which is mixed from the low gamma L of the first preset pattern and the low gamma L of the second preset pattern in the cascade method.

Therefore, the gamma data generator 300 is configured to output one of a plurality of mixing gamma data HH, HL, LH and LL corresponding to the image data of the sub-pixel.

Figure 4:
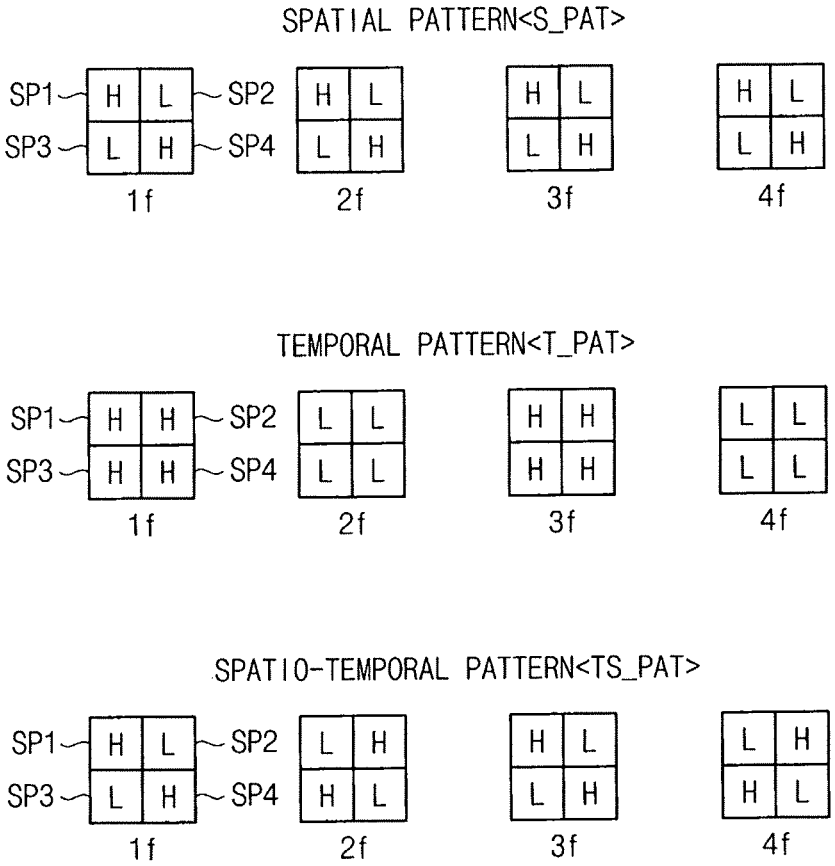
FIG. 4 is a hybrid diagram illustrating a pattern memory of FIG. 2.

FIG. 4 is a diagram illustrating a pattern memory of FIG. 2.

Referring to FIGS. 2 and 4, first or second pattern memory 330 or 370 may be configured to store a plurality of spatial patterns S_PAT, a plurality of temporal patterns T_PAT and a plurality of spatio-temporal patterns TS_PAT corresponding to a plurality of sub-pixels arranged in an (n×m) matrix array (where 'n' and 'm' are natural numbers).

For example, referring to sub-pixels SP1, SP2, SP3 and SP4 arranged in a (2×2) matrix array, a first sub-pixel SP1 is adjacent to a second sub-pixel SP2 in a horizontal direction, a third sub-pixel SP3 is adjacent to the first sub-pixel SP1 in a vertical direction, a the fourth sub-pixel SP4 is adjacent to the third sub-pixel SP2 in the horizontal direction.

For example, the spatial pattern S_PAT has the high gamma H corresponding to the first and fourth sub-pixels SP1 and SP4 and has the low gamma L corresponding to the second and third sub-pixels SP2 and SP3. Thus, the high gamma H and the low gamma L of S_PAT are divided in a space corresponding to the first to fourth sub-pixels SP1, SP2, SP3 and SP4 but are not divided in a time corresponding to sequential first to fourth frames 1*f*, 2*f*, 3*f* and 4*f*. Thus, during sequential first to fourth frames 1*f*, 2*f*, 3*f* and 4*f*, the high gamma H is applied to the first and fourth sub-pixels SP1 and SP4 and the low gamma L is applied to the second and third sub-pixels SP2 and SP3.

For example, the temporal pattern T_PAT has the high gamma H corresponding to the first to fourth sub-pixels SP1, SP2, SP3 and SP4 during a first frame if and has the low gamma L corresponding to the first to fourth sub-pixels SP1, SP2, SP3 and SP4 during a second frame 2*f*. Thus, the high gamma H and the low gamma L of T_PAT are not divided in the space corresponding to the first to fourth sub-pixels SP1, SP2, SP3 and SP4 but are divided in the time corresponding to sequential first to fourth frames 1*f*, 2*f*, 3*f* and 4*f*. Therefore, during sequential first to fourth frames 1*f*, 2*f*, 3*f* and 4*f*, the high gamma H and the low gamma L are alternately applied to the first to fourth sub-pixels SP1, SP2, SP3 and SP4.

For example, the spatio-temporal pattern TS_PAT has the high gamma H corresponding to the first and fourth sub-pixels SP1 and SP4, has the low gamma L corresponding to the second and third sub-pixels SP2 and SP3. Thus, the high gamma H and the low gamma L of TS_PAT are divided in the space corresponding to the first to fourth sub-pixels SP1, SP2, SP3 and SP4. In addition, the spatio-temporal pattern TS_PAT has the high gamma H corresponding to the first and fourth sub-pixels SP1 and SP4 and the low gamma L corresponding to the second and third sub-pixels SP2 and SP3 during a first frame 1*f* and has the low gamma L corresponding to the first and fourth sub-pixels SP1 and SP4 and the high gamma H corresponding to the second and third sub-pixels SP2 and SP3 during a second frame 2*f*. Thus, the high gamma H and the low gamma L are divided in the time corresponding to sequential first to fourth frames 1*f*, 2*f*, 3*f* and 4*f*. Therefore, the high gamma H and the low gamma L are divided in the space corresponding to the first to fourth sub-pixels SP1, SP2, SP3 and SP4, and are divided in the time corresponding to sequential first to fourth frames 1*f*, 2*f*, 3*f* and 4*f*.

As described above, the spatial pattern S_PAT has the high gamma H and the low gamma L corresponding to a plurality of sub-pixels arranged in an (n×m) matrix array in a space division method ('n' and 'm' are natural numbers). The temporal pattern T_PAT has the high gamma H and the low gamma L corresponding to the plurality of sub-pixels in a time division method. The spatio-temporal pattern TS_PAT has the high gamma H and the low gamma L corresponding to the plurality of sub-pixels in both a space and time division method. The spatial pattern S_PAT, the temporal pattern T_PAT and the spatio-temporal pattern TS_PAT may be designed variously, without limitation.

According to the exemplary embodiment, the first or second pattern memory 330 or 350 may include at least one spatial pattern, at least one temporal pattern and at least one spatio-temporal pattern.

In addition, the first gamma controller 350 and the second gamma controller 390 may individually select according to various driving conditions, such as a pixel structure and an inversion driving mode, etc.

According to the various driving conditions, the first gamma controller 350 may select one among the spatial pattern, the temporal pattern and the spatio-temporal pattern and then the second gamma controller 390 may select one among the spatial pattern, the temporal pattern and the spatio-temporal pattern. Thus, at least 9 gamma mixing conditions may be designed by the first gamma controller 350 and the second gamma controller 390.

Figure 5:
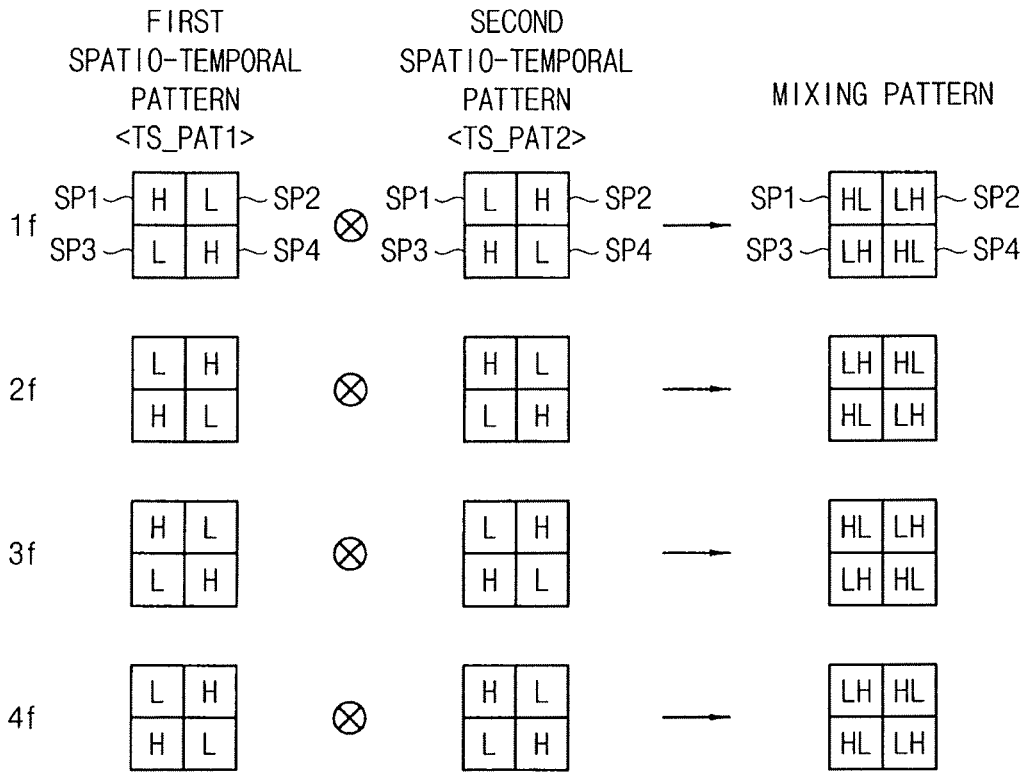
FIG. 5 is a hybrid diagram illustrating first and second gamma controller according to an exemplary embodiment.

FIG. 5 is a diagram illustrating first and second gamma controllers according to an exemplary embodiment.

Referring to FIG. 5, a first preset pattern may be referred as to a first spatio-temporal pattern TS_PAT1, and a second preset pattern may be referred as to a second spatio-temporal pattern TS_PAT2. The first and second spatio-temporal patterns TS_PAT1 and TS_PAT2 may corresponding to sub-pixels SP1, SP2, SP3 and SP4 arranged in a (2×2) matrix array.

The first spatio-temporal pattern TS_PAT1 has a high gamma H corresponding to the first and fourth sub-pixels SP1 and SP4 and a low gamma L corresponding to the second and third sub-pixels SP2 and SP3 during a first frame, and has the low gamma L corresponding to the first and fourth sub-pixels SP1 and SP4 and high gamma H corresponding to the second and third sub-pixels SP2 and SP3 during a second frame.

The second spatio-temporal pattern TS_PAT2 has the high gamma H and the low gamma L opposite to those of the first spatio-temporal pattern TS_PAT1, corresponding to the first to fourth sub-pixels SP1, SP2, SP3 and SP4.

Referring to FIGS. 2 and 5, during a first frame 1*f*, the first gamma controller 350 is configured to output first gamma data of the first to fourth sub-pixels SP1, SP2, SP3 and SP4 based on the first spatio-temporal pattern TS_PAT1 stored in the first pattern memory 330. The first gamma controller 350 is configured to output high gamma data of a high gamma LUT 311 corresponding to image data of the first sub-pixel SP1 as first gamma data of the first sub-pixel SP1, low gamma data of a low gamma LUT 312 corresponding to image data of the second sub-pixel SP2 as first gamma data of the second sub-pixel SP2, low gamma data of the low gamma LUT 312 corresponding to image data of the third sub-pixel SP3 as first gamma data of the third sub-pixel SP3 and high gamma data of the high gamma LUT 311 corresponding to image data of the fourth sub-pixel SP4 as first gamma data of the fourth sub-pixel SP4.

Then, the second gamma controller 390 is configured to output second gamma data of the first to fourth sub-pixels SP1, SP2, SP3 and SP4 based on the second spatio-temporal pattern TS_PAT2 stored in the second pattern memory 370. The second gamma controller 390 is configured to output low gamma data of the low gamma LUT 312 corresponding to the first gamma data of the first sub-pixel SP1 as second gamma data of the first sub-pixel SP1, high gamma data of the high gamma LUT 311 corresponding to the first gamma data of the second sub-pixel SP2 as second gamma data of the second sub-pixel SP2, high gamma data of the high gamma LUT 311 corresponding to the first gamma data of the third sub-pixel SP3, and low gamma data of the low gamma LUT 312 corresponding to the first gamma data of the fourth sub-pixel SP4 as second gamma data of the fourth sub-pixel SP4.

Therefore, during the first frame 1*f*, the gamma data generator 300 is configured to output second mixing gamma data HL corresponding to the image data DIN of the first sub-pixel SP1, third mixing gamma data LH corresponding to the image data DIN of the second sub-pixel SP2, third mixing gamma data LH corresponding to the image data DIN of the third sub-pixel SP3 and second mixing gamma data HL corresponding to the image data DIN of the fourth sub-pixel SP4 (DOUT).

During a second frame 2*f*, the gamma data generator 300 is configured to output third mixing gamma data LH corresponding to the image data DIN of the first sub-pixel SP1, second mixing gamma data HL corresponding to the image data DIN of the second sub-pixel SP2, second mixing gamma data HL corresponding to the image data DIN of the third sub-pixel SP3 and third mixing gamma data LH corresponding to the image data DIN of the fourth sub-pixel SP4 (DOUT).

During a third frame 3*f*, the gamma data generator 300 is configured to output second mixing gamma data HL corresponding to the image data DIN of the first sub-pixel SP1, third mixing gamma data LH corresponding to the image data DIN of the second sub-pixel SP2, third mixing gamma data LH corresponding to the image data DIN of the third sub-pixel SP3 and second mixing gamma data HL corresponding to the image data DIN of the fourth sub-pixel SP4 (DOUT).

During a fourth frame 4*f*, the gamma data generator 300 is configured to output third mixing gamma data LH corresponding to the image data DIN of the first sub-pixel SP1, second mixing gamma data HL corresponding to the image data DIN of the second sub-pixel SP2, second mixing gamma data HL corresponding to the image data DIN of the third sub-pixel SP3 and third mixing gamma data LH corresponding to the image data DIN of the fourth sub-pixel SP4 (DOUT).

Therefore, the gamma data generator 300 is configured to output mixing gamma data HL, LH, HL and LH respectively corresponding to image data of the first to fourth sub-pixels SP1, SP2, SP3 and SP4.

Figure 6:
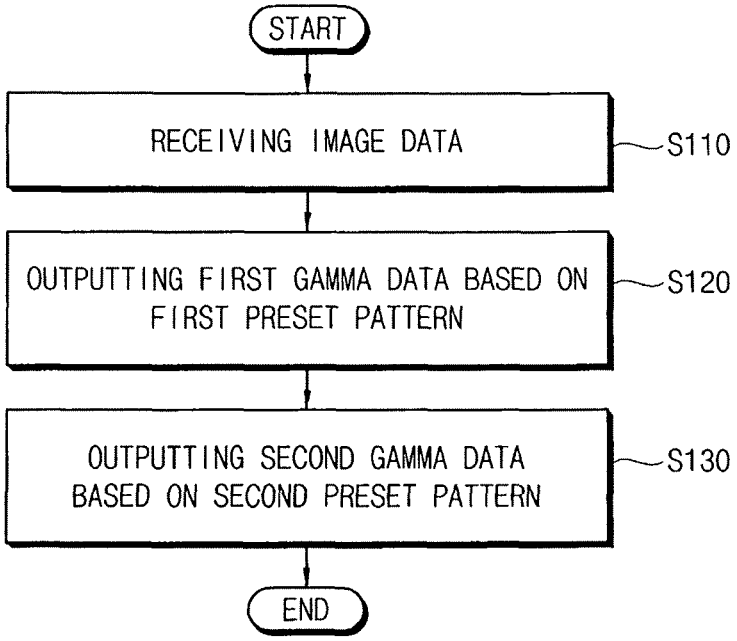
FIG. 6 is a flowchart diagram illustrating a method of driving a display apparatus according to an exemplary embodiment.

FIG. 6 is a flowchart illustrating a method of driving a display apparatus according to an exemplary embodiment. FIG. 7 is a diagram illustrating high and low gamma look-up tables according to an exemplary embodiment.

Referring to FIGS. 5, 6 and 7, image data of the first to fourth sub-pixels SP1, SP2, SP3 and SP4 are referred to as a 170-grayscale 170G.

The first gamma controller 250 is configured to receive the 170-grayscale 170G of the image data DIN corresponding to the first, second, third and fourth sub-pixels SP1, SP2, SP3 and SP4 (Step S110).

The first gamma controller 350 is configured to output first gamma data of the first to fourth sub-pixels SP1, SP2, SP3 and SP4 based on the first spatio-temporal pattern TS_PAT1 stored in the first pattern memory 330 as shown in FIG. 5. The first gamma controller 350 is configured to output high gamma data of a high gamma LUT 311 corresponding to image data of the first sub-pixel SP1 as first gamma data of the first sub-pixel SP1, low gamma data of a low gamma LUT 312 corresponding to image data of the second sub-pixel SP2 as first gamma data of the second sub-pixel SP2, low gamma data of the low gamma LUT 312 corresponding to image data of the third sub-pixel SP3 as first gamma data of the third sub-pixel SP3 and high gamma data of the high gamma LUT 311 corresponding to image data of the fourth sub-pixel SP4 as first gamma data of the fourth sub-pixel SP4 (Step S120).

For example, referring to FIGS. 5 and 7, the first gamma controller 350 is configured to output a 230-grayscale 230G being the high gamma data of the high gamma LUT 311 corresponding to the 170-grayscale 170G of the first sub-pixel SP1 as the first gamma data of the first sub-pixel SP1, a 10-grayscale 10G being the low gamma data of the low gamma LUT 312 corresponding to the 170-grayscale 170G of the second sub-pixel SP2 as the first gamma data of the second sub-pixel SP2, the 10-grayscale 10G being the low gamma data of the low gamma LUT 312 corresponding to the 170-grayscale 170G of the third sub-pixel SP3 as the first gamma data of the third sub-pixel SP3 and the 230-grayscale 230G being the high gamma data of the high gamma LUT 311 corresponding to the 170-grayscale 170G of the fourth sub-pixel SP4 as the first gamma data of the fourth sub-pixel SP4.

Then, the second gamma controller 390 is configured to output second gamma data of the first to fourth sub-pixels SP1, SP2, SP3 and SP4 based on the second spatio-temporal pattern TS_PAT2 stored in the second pattern memory 370 as shown in FIG. 5. The second gamma controller 390 is configured to output low gamma data of the low gamma LUT 312 corresponding to the first gamma data of the first sub-pixel SP1 as second gamma data of the first sub-pixel SP1, high gamma data of the high gamma LUT 311 corresponding to the first gamma data of the second sub-pixel SP2 as second gamma data of the second sub-pixel SP2, high gamma data of the high gamma LUT 311 corresponding to the first gamma data of the third sub-pixel SP3, and low gamma data of the low gamma LUT 312 corresponding to the first gamma data of the fourth sub-pixel SP4 as second gamma data of the fourth sub-pixel SP4 (Step S130).

For example, referring to FIGS. 5 and 7, the second gamma controller 390 is configured to output a 160-grayscale 160G being low gamma data of the low gamma LUT 312 corresponding to the 230-grayscale 230G being the first gamma data of the first and fourth sub-pixels SP1 and SP4 as second gamma data of the first and fourth sub-pixels SP1 and SP4. Thus, the gamma data generator 300 is configured to output the 160-grayscale 160G of second mixing gamma data HL corresponding to the 170-grayscale 170G being the image data of the first and fourth sub-pixels SP1 and SP4.

In addition, the second gamma controller 390 is configured to output a 80-grayscale 80G being low gamma data of the low gamma LUT 312 corresponding to the 10-grayscale 10G being the first gamma data of the second and third sub-pixels SP2 and SP3 as second gamma data of the second and third sub-pixels SP2 and SP3. Thus, the gamma data generator 300 is configured to output the 80-grayscale 80G of third mixing gamma data LH corresponding to the 170-grayscale 170G being the image data of the second and third sub-pixels SP2 and SP3.

Although not shown in the figures, when the high gamma H of the first spatio-temporal pattern and the high gamma H of the second spatio-temporal pattern are applied to a sub-pixel having the image data of the 170-grayscale 170G, the gamma data generator 300 may be configured to output first mixing gamma data HH of a 255-grayscale 255G corresponding to the 170-grayscale 170G. When the low gamma L of the first spatio-temporal pattern and the low gamma L of the second spatio-temporal pattern are applied to a sub-pixel having the image data of the 170-grayscale 170G, the gamma data generator 300 may be configured to output fourth mixing gamma data LL of a 0-grayscale OG corresponding to the 170-grayscale 170G.

Figure 8:
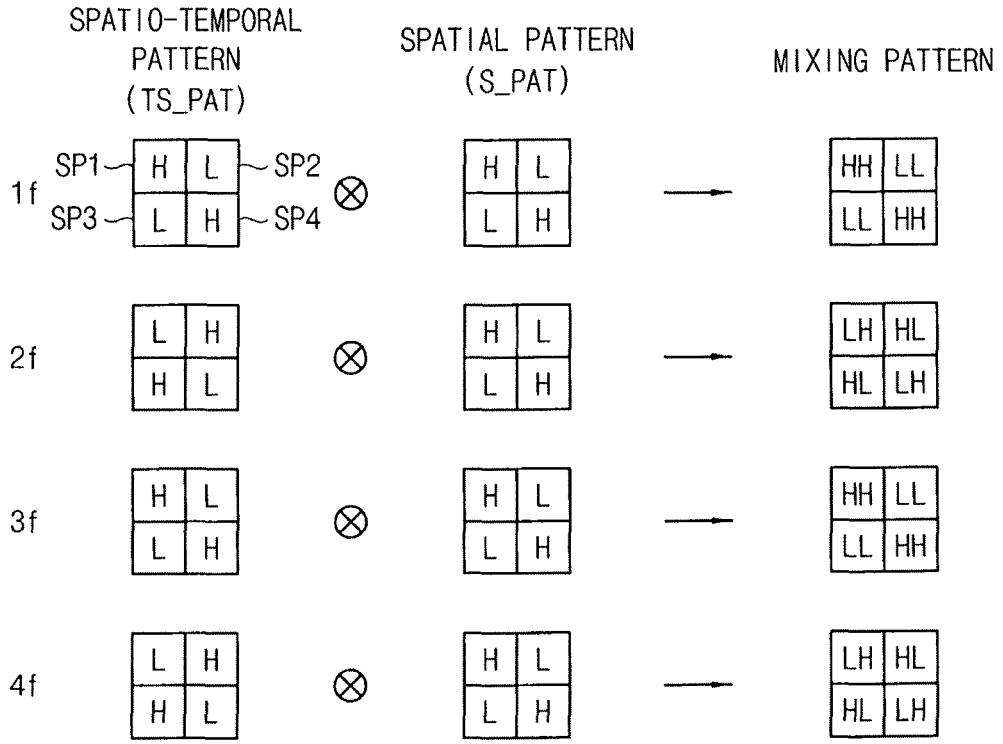
FIG. 8 is a hybrid diagram illustrating first and second gamma controller according to an exemplary embodiment.

FIG. 8 is a diagram illustrating first and second gamma controllers according to an exemplary embodiment.

Referring to FIG. 8, a first preset pattern may be referred to as a spatio-temporal pattern TS_PAT, and a second preset pattern may be referred to as a spatial pattern S_PAT. The first and second preset patterns may correspond to sub-pixels SP1, SP2, SP3 and SP4 arranged in a (2×2) matrix array.

The spatio-temporal pattern TS_PAT has a high gamma H corresponding to the first and fourth sub-pixels SP1 and SP4 and a low gamma L corresponding to the second and third sub-pixels SP2 and SP3 during a first frame, and has the low gamma L corresponding to the first and fourth sub-pixels SP1 and SP4 and high gamma H corresponding to the second and third sub-pixels SP2 and SP3 during a second frame.

The spatial pattern S_PAT has the high gamma H corresponding to the first and fourth sub-pixels SP1 and SP4 and the low gamma L corresponding to the second and third sub-pixels SP2 and SP3.

Referring to FIGS. 2 and 8, during a first frame 1*f*, the first gamma controller 350 is configured to output high gamma data of a high gamma LUT 311 corresponding to image data of the first sub-pixel SP1 as first gamma data of the first sub-pixel SP1, low gamma data of a low gamma LUT 312 corresponding to image data of the second sub-pixel SP2 as first gamma data of the second sub-pixel SP2, low gamma data of the low gamma LUT 312 corresponding to image data of the third sub-pixel SP3 as first gamma data of the third sub-pixel SP3 and high gamma data of the high gamma LUT 311 corresponding to image data of the fourth sub-pixel SP4 as first gamma data of the fourth sub-pixel SP4, based on the spatio-temporal pattern TS_PAT in the first pattern memory 330.

Then, the second gamma controller 390 is configured to output high gamma data of the high gamma LUT 311 corresponding to the first gamma data of the first sub-pixel SP1 as second gamma data of the first sub-pixel SP1, low gamma data of the low gamma LUT 312 corresponding to the first gamma data of the second sub-pixel SP2 as second gamma data of the second sub-pixel SP2, low gamma data of the low gamma LUT 312 corresponding to the first gamma data of the third sub-pixel SP3, and high gamma data of the high gamma LUT 311 corresponding to the first gamma data of the fourth sub-pixel SP4 as second gamma data of the fourth sub-pixel SP4, based on the spatial pattern S_PAT in the second pattern memory 370.

Therefore, during the first frame 1*f*, the gamma data generator 300 is configured to output first mixing gamma data HH corresponding to the image data DIN of the first sub-pixel SP1, fourth mixing gamma data LL corresponding to the image data DIN of the second sub-pixel SP2, fourth mixing gamma data LL corresponding to the image data DIN of the third sub-pixel SP3 and first mixing gamma data HH corresponding to the image data DIN of the fourth sub-pixel SP4 (DOUT).

During a second frame 2*f*, the gamma data generator 300 is configured to output third mixing gamma data LH corresponding to the image data DIN of the first sub-pixel SP1, second mixing gamma data HL corresponding to the image data DIN of the second sub-pixel SP2, second mixing gamma data HL corresponding to the image data DIN of the third sub-pixel SP3 and third mixing gamma data LH corresponding to the image data DIN of the fourth sub-pixel SP4 (DOUT).

During a third frame 3*f*, the gamma data generator 300 is configured to output first mixing gamma data HH corresponding to the image data DIN of the first sub-pixel SP1, fourth mixing gamma data LL corresponding to the image data DIN of the second sub-pixel SP2, fourth mixing gamma data LL corresponding to the image data DIN of the third sub-pixel SP3 and first mixing gamma data HH corresponding to the image data DIN of the fourth sub-pixel SP4 (DOUT).

During a fourth frame 4*f*, the gamma data generator 300 is configured to output third mixing gamma data LH corresponding to the image data DIN of the first sub-pixel SP1, second mixing gamma data HL corresponding to the image data DIN of the second sub-pixel SP2, second mixing gamma data HL corresponding to the image data DIN of the third sub-pixel SP3 and third mixing gamma data LH corresponding to the image data DIN of the fourth sub-pixel SP4 (DOUT).

Figure 9:
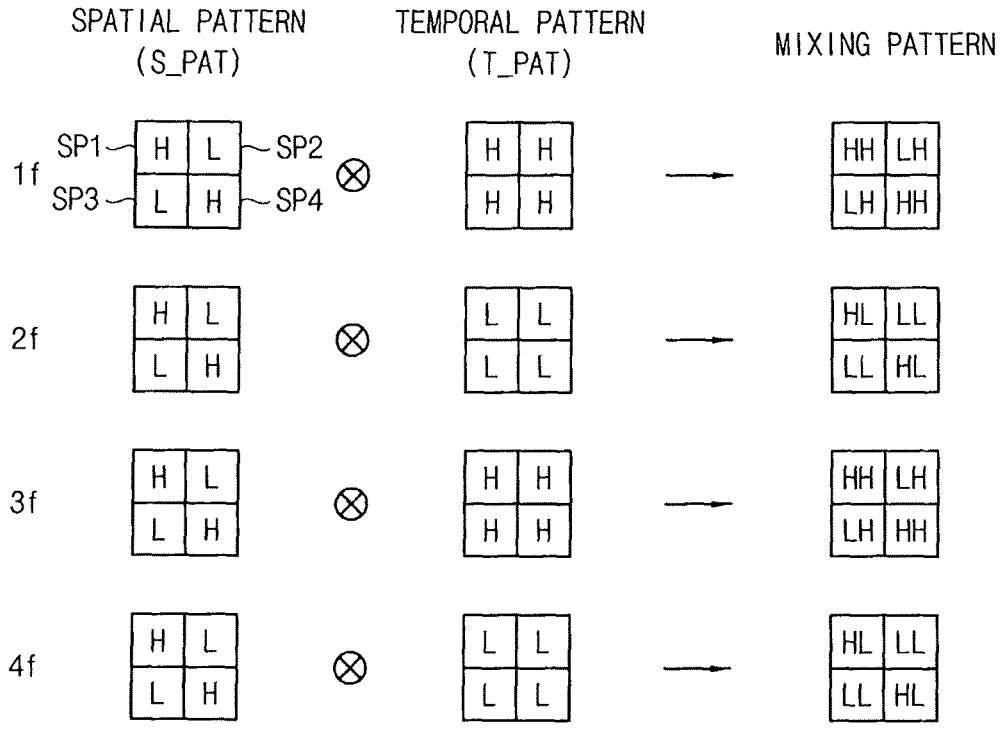
FIG. 9 is a hybrid diagram illustrating first and second gamma controller according to an exemplary embodiment.

FIG. 9 is a diagram illustrating first and second gamma controllers according to an exemplary embodiment.

Referring to FIG. 9, a first preset pattern may be referred as to a spatial pattern S_PAT, and a second preset pattern may be referred as to a temporal pattern T_PAT. The first and second preset patterns may correspond to sub-pixels SP1, SP2, SP3 and SP4 arranged in a (2×2) matrix array.

The spatial pattern S_PAT has a high gamma H corresponding to the first and fourth sub-pixels SP1 and SP4 and a low gamma L corresponding to the second and third sub-pixels SP2 and SP3.

The temporal pattern T_PAT has the high gamma H corresponding to the first to fourth sub-pixels SP1, SP2, SP3 and SP4 during a first frame 1*f*, has the low gamma L corresponding to the first to fourth sub-pixels SP1, SP2, SP3 and SP4 during a second frame 2*f*, has the high gamma H corresponding to the first to fourth sub-pixels SP1, SP2, SP3 and SP4 during a third frame 3*f* and has the low gamma L to the first to fourth sub-pixels SP1, SP2, SP3 and SP4 during a fourth frame 4*f*.

Referring to FIGS. 2 and 9, during the first frame 1*f*, the first gamma controller 350 is configured to output high gamma data of a high gamma LUT 311 corresponding to image data of the first sub-pixel SP1 as first gamma data of the first sub-pixel SP1, low gamma data of a low gamma LUT 312 corresponding to image data of the second sub-pixel SP2 as first gamma data of the second sub-pixel SP2, low gamma data of the low gamma LUT 312 corresponding to image data of the third sub-pixel SP3 as first gamma data of the third sub-pixel SP3 and high gamma data of the high gamma LUT 311 corresponding to image data of the fourth sub-pixel SP4 as first gamma data of the fourth sub-pixel SP4, based on the spatial pattern S_PAT in the first pattern memory 330.

Then, the second gamma controller 390 is configured to output high gamma data of the high gamma LUT 311 corresponding to the first gamma data of the first sub-pixel SP1 as second gamma data of the first sub-pixel SP1, high gamma data of the high gamma LUT 311 corresponding to the first gamma data of the second sub-pixel SP2 as second gamma data of the second sub-pixel SP2, high gamma data of the high gamma LUT 311 corresponding to the first gamma data of the third sub-pixel SP3, and high gamma data of the high gamma LUT 311 corresponding to the first gamma data of the fourth sub-pixel SP4 as second gamma data of the fourth sub-pixel SP4, based on the temporal pattern T_PAT in the second pattern memory 370.

Therefore, during the first frame 1*f*, the gamma data generator 300 is configured to output first mixing gamma data HH corresponding to the image data DIN of the first sub-pixel SP1, third mixing gamma data LH corresponding to the image data DIN of the second sub-pixel SP2, third mixing gamma data LH corresponding to the image data DIN of the third sub-pixel SP3 and first mixing gamma data HH corresponding to the image data DIN of the fourth sub-pixel SP4 (DOUT).

During a second frame 2*f*, the gamma data generator 300 is configured to output second mixing gamma data HL corresponding to the image data DIN of the first sub-pixel SP1, fourth mixing gamma data LL corresponding to the image data DIN of the second sub-pixel SP2, fourth mixing gamma data LL corresponding to the image data DIN of the third sub-pixel SP3 and second mixing gamma data HL corresponding to the image data DIN of the fourth sub-pixel SP4 (DOUT).

During a third frame 3*f*, the gamma data generator 300 is configured to output first mixing gamma data HH corresponding to the image data DIN of the first sub-pixel SP1, third mixing gamma data LH corresponding to the image data DIN of the second sub-pixel SP2, third mixing gamma data LH corresponding to the image data DIN of the third sub-pixel SP3 and first mixing gamma data HH corresponding to the image data DIN of the fourth sub-pixel SP4 (DOUT).

During a fourth frame 4*f*, the gamma data generator 300 is configured to output second mixing gamma data HL corresponding to the image data DIN of the first sub-pixel SP1, fourth mixing gamma data LL corresponding to the image data DIN of the second sub-pixel SP2, fourth mixing gamma data LL corresponding to the image data DIN of the third sub-pixel SP3 and second mixing gamma data HL corresponding to the image data DIN of the fourth sub-pixel SP4 (DOUT).

Figure 10:
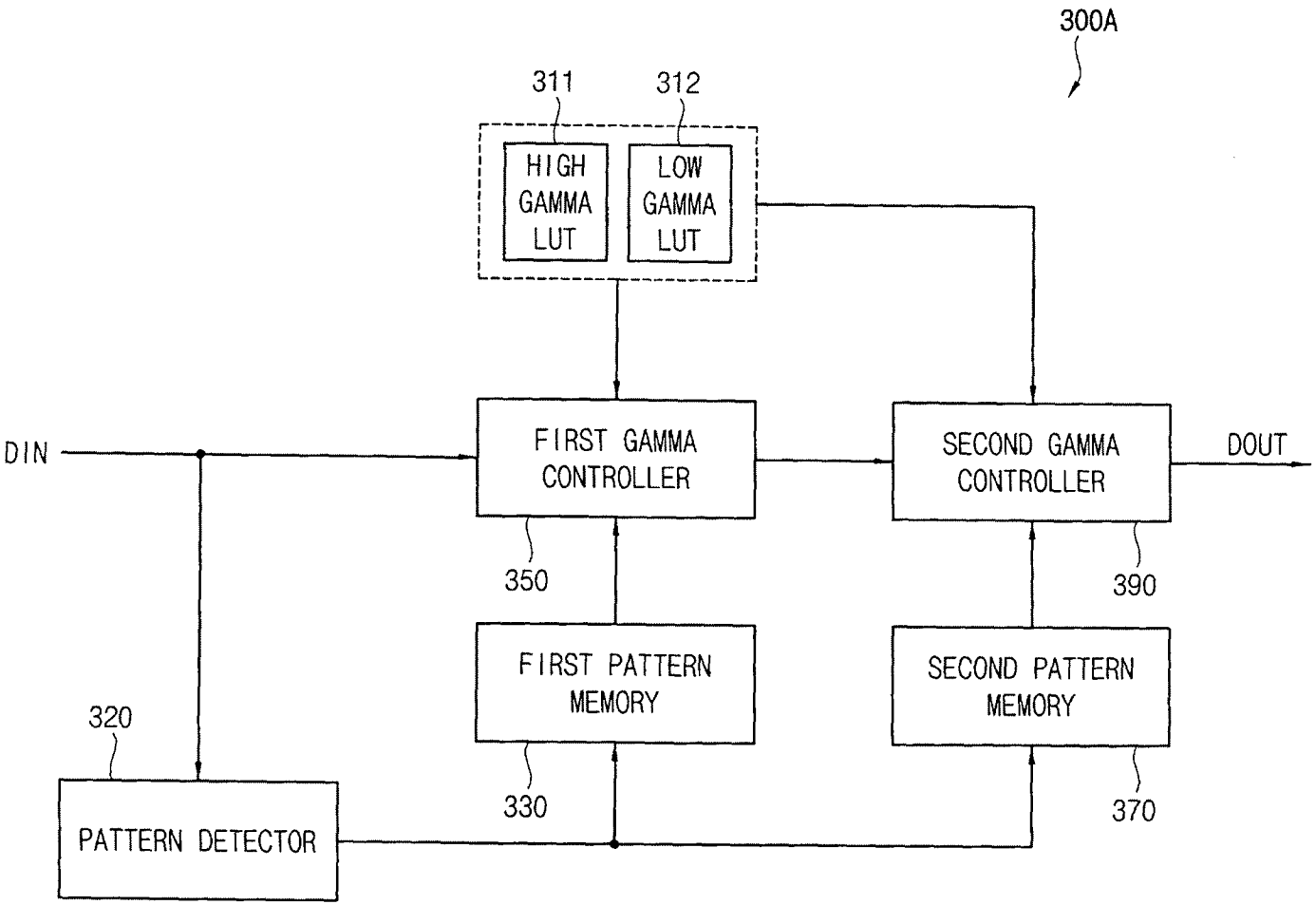
FIG. 10 is a block diagram illustrating a gamma data generator according to an exemplary embodiment.
Figure 11A:
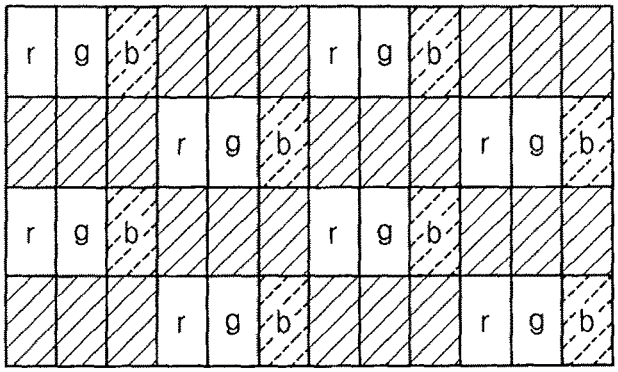
FIGS. 11A and 11B are hybrid diagrams illustrating a pattern detector of FIG. 10.
Figure 11B:
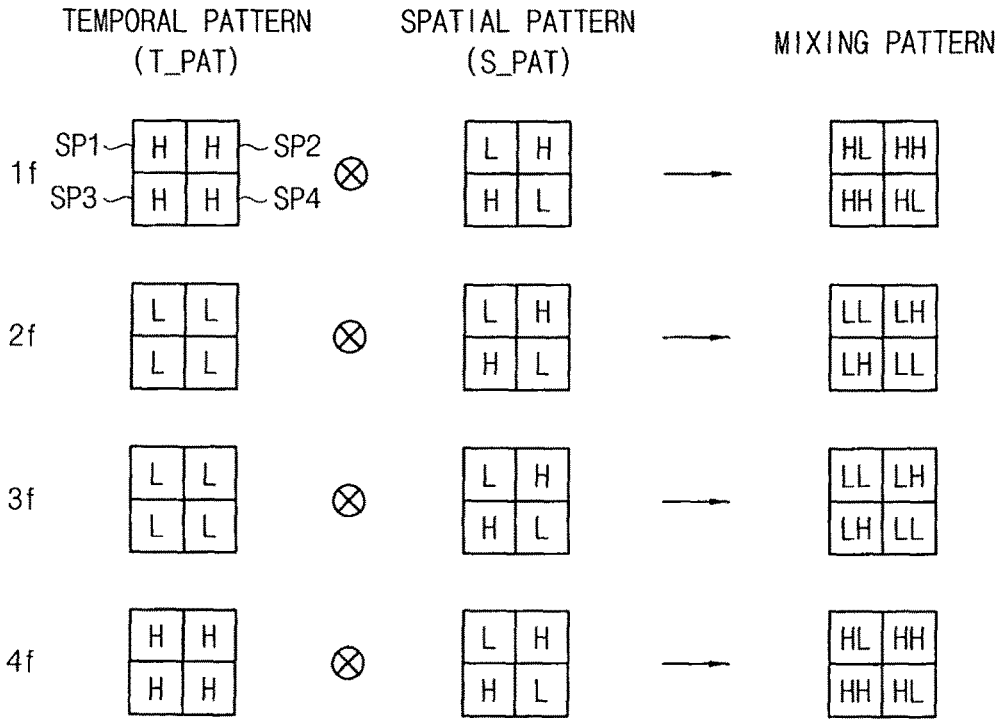

FIG. 10 is a block diagram illustrating a gamma data generator according to an exemplary embodiment. FIGS. 11A and 11B are diagrams illustrating a pattern detector of FIG. 10.

Referring to FIGS. 1 and 10, the gamma data generator 300A may include a high gamma LUT 311, a low gamma LUT 312, a pattern detector 320 connected to the data image data input, a first pattern memory 330 connected to the pattern detector, a first gamma controller 350 connected to an image data input DIN and the first pattern memory and the LUTs, a second pattern memory 370 connected to the pattern detector, and a second gamma controller 390 connected to the second pattern memory and the first gamma controller and the LUTs and providing image data output DOUT.

The high gamma LUT 311 is configured to store high gamma data corresponding to each of the grayscales based on the high gamma H as shown in FIG. 3.

The low gamma LUT is configured to store low gamma data corresponding to each of the grayscales based on the low gamma L as shown in FIG. 3.

The pattern detector 320 is configured to analyze the image data and to detect an image pattern of the image data. The pattern detector 320 is configured to determine an optimal first preset pattern and an optimal second preset pattern corresponding to the image pattern in order that display defects according to the image pattern may be substantially invisible to an observer.

The first pattern memory 330 is configured to store a spatial pattern, a temporal pattern and a spatio-temporal pattern.

The first gamma controller 350 is configured to select a first preset pattern which is one among the spatial, temporal and spatio-temporal patterns in the first pattern memory 330 based on a control of the pattern detector 320, and to generate first gamma data of the sub-pixel being high gamma data or low gamma data corresponding to the image data of the sub-pixel using the first preset pattern.

The second pattern memory 370 is configured to store a spatial pattern, a temporal pattern and a spatio-temporal pattern.

The second gamma controller 390 is configured to select a second preset pattern which is one among the spatial, temporal and spatio-temporal patterns in the second pattern memory 370 based on a control of the pattern detector 320, and to generate second gamma data of the sub-pixel being high gamma data or low gamma data corresponding to the first gamma data of the sub-pixel using the second preset pattern.

For example, as shown in FIG. 11A, when the image pattern is a dot pattern, red and green sub-pixels view brighter than a blue sub-pixel. Thus, when the image pattern is a dot pattern, a display defect in which the red and green sub-pixels view brighter than a blue sub-pixel may be invisible to an observer by a mixing condition which is mixed from the temporal pattern T_PAT and the spatial pattern S_PAT.

Therefore, when the image pattern is the dot pattern such as shown in FIG. 11A, the temporal pattern T_PAT may be selected as the optimal first preset pattern and the spatial pattern S_PAT may be selected as the optimal second preset pattern.

The first gamma controller 350 is configured to output the first gamma data corresponding to the image data using the temporal pattern T_PAT in the first pattern memory 330 based on the control of the pattern detector 320. Then, the second gamma controller 390 is configured to output the second gamma data corresponding to the first gamma data using the spatial pattern S_PAT in the second pattern memory 370 based on the control of the pattern detector 320.

As described above, according to the exemplary embodiment, an optimal mixing condition is determined according to the image pattern such that display quality as well as side visibility may be optimized.

Figure 12:
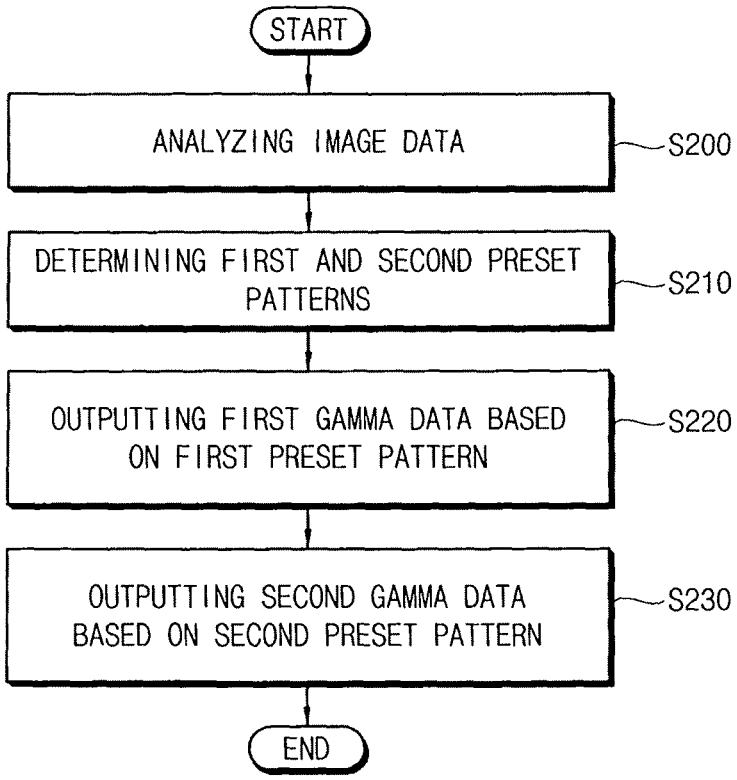
FIG. 12 a flowchart diagram illustrating a method of driving a display apparatus according to an exemplary embodiment.

FIG. 12 a flowchart illustrating a method of driving a display apparatus according to an exemplary embodiment.

Referring to FIGS. 10, 11A, 11B and 12, the pattern detector 320 is configured to detect an image pattern of the image data (Step S200). The pattern detector 320 is configured to determine optimal first and second preset patterns to avoid display defects corresponding to the image pattern (Step S210).

For example, when the image pattern is the dot pattern as shown in FIG. 11A, the pattern detector 320 may determine the temporal pattern T_PAT as the first preset pattern the spatial pattern S_PAT as the second preset pattern.

Referring to FIG. 11B, the temporal pattern T_PAT and the spatial pattern S_PAT may correspond to sub-pixels SP1, SP2, SP3 and SP4 arranged in a (2×2) matrix array, without limitation. The temporal pattern T_PAT has a high gamma H corresponding to the first to fourth sub-pixels SP1, SP2, SP3 and SP4 during a first frame 1*f*, has a low gamma L corresponding to the first to fourth sub-pixels SP1, SP2, SP3 and SP4 during a second frame 2*f*, has the low gamma L corresponding to the first to fourth sub-pixels SP1, SP2, SP3 and SP4 during a third frame 3*f* and has the high gamma H corresponding to the first to fourth sub-pixels SP1, SP2, SP3 and SP4 during a fourth frame 4*f*.

The spatial pattern S_PAT has the low gamma L corresponding to the first and fourth sub-pixels SP1 and SP4 and the high gamma H corresponding to the second and third sub-pixels SP2 and SP3.

Referring to FIGS. 10 and 11B, during the first frame 1*f*, the first gamma controller 350 is configured to output high gamma data of the high gamma LUT 311 corresponding to the image data of the first to fourth sub-pixels SP1, SP2, SP3 and SP4 as first gamma data of the first to fourth sub-pixels SP1, SP2, SP3 and SP4, based on the temporal pattern T_PAT in the first pattern memory 330 (Step S220).

Then, the second gamma controller 390 is configured to output low gamma data of the low gamma LUT 312 corresponding to the first gamma data of the first sub-pixel SP1 as second gamma data of the first sub-pixel SP1, high gamma data of the high gamma LUT 311 corresponding to the first gamma data of the second sub-pixel SP2 as second gamma data of the second sub-pixel SP2, high gamma data of the high gamma LUT 311 corresponding to the first gamma data of the third sub-pixel SP3, and low gamma data of the low gamma LUT 312 corresponding to the first gamma data of the fourth sub-pixel SP4 as second gamma data of the fourth sub-pixel SP4, based on the spatial pattern S_PAT in the second pattern memory 370 (Step S230).

Therefore, during the first frame 1*f*, the gamma data generator 300A is configured to output second mixing gamma data HL corresponding to the image data DIN of the first sub-pixel SP1, first mixing gamma data HH corresponding to the image data DIN of the second sub-pixel SP2, first mixing gamma data HH corresponding to the image data DIN of the third sub-pixel SP3 and second mixing gamma data HL corresponding to the image data DIN of the fourth sub-pixel SP4.

During a second frame 2*f*, the gamma data generator 300 is configured to output fourth mixing gamma data LL corresponding to the image data DIN of the first sub-pixel SP1, third mixing gamma data LH corresponding to the image data DIN of the second sub-pixel SP2, third mixing gamma data LH corresponding to the image data DIN of the third sub-pixel SP3 and fourth mixing gamma data LL corresponding to the image data DIN of the fourth sub-pixel SP4.

During the third frame 3*f*, the gamma data generator 300 is configured to output fourth mixing gamma data LL corresponding to the image data DIN of the first sub-pixel SP1, third mixing gamma data LH corresponding to the image data DIN of the second sub-pixel SP2, third mixing gamma data LH corresponding to the image data DIN of the third sub-pixel SP3 and fourth mixing gamma data LL corresponding to the image data DIN of the fourth sub-pixel SP4.

During the fourth frame 4*f*, the gamma data generator 300A is configured to output second mixing gamma data HL corresponding to the image data DIN of the first sub-pixel SP1, first mixing gamma data HH corresponding to the image data DIN of the second sub-pixel SP2, first mixing gamma data HH corresponding to the image data DIN of the third sub-pixel SP3 and second mixing gamma data HL corresponding to the image data DIN of the fourth sub-pixel SP4.

Although not shown in figures, each sub-pixel may be divided into a plurality of sub-areas, and each of the plurality of sub-areas may be individually driven. For example, the sub-pixel may be divided into a first sub-area and a second sub-area.

In this case, as the described exemplary embodiments above, each of the first and second sub-areas is driven using a mixing gamma which is mixed from the high gamma and the low gamma, such as a high/high mixing gamma, a high/low mixing gamma, a low/high mixing gamma and a low/low mixing gamma.

According to the exemplary embodiments, multi-gammas may be designed using both high and low gammas and thus, side visibility may be optimized. In alternate embodiments, the high gamma need not be universally as high as or higher than the low gamma. In alternate embodiments, more than two gamma look-up tables, curves or functions may be connected to the gamma controllers. In alternate embodiments, two or more of the same or different types among the spatial, temporal, or spatio-temporal methods may be used simultaneously. In alternate embodiments, more than two gamma controllers may be configured to generate additional gamma data for a plurality of sub-pixels.

The foregoing is illustrative of the inventive concept and is not to be construed as limiting thereof. Although a few exemplary embodiments of the inventive concept have been described, those of ordinary skill in the pertinent art will readily appreciate that many modifications are possible in the exemplary embodiments without materially departing from the novel teachings and advantages of the inventive concept. Accordingly, all such modifications are intended to be included within the scope of the inventive concept as defined in the claims. Therefore, it is to be understood that the foregoing is illustrative of the inventive concept and is not to be construed as limited to the specific exemplary embodiments disclosed, and that modifications to the disclosed exemplary embodiments, as well as other embodiments, are intended to be included within the scope of the appended claims. The inventive concept is defined by the following claims, with equivalents of the claims to be included therein.

What is claimed is:

1. A display apparatus comprising:

a display panel comprising a data line, a gate line and a sub-pixel connected between the data line and the gate line;

a gamma data generator comprising a spatial pattern having a high gamma and a low gamma corresponding to a plurality of sub-pixels arranged in a matrix array for a space division configuration, a temporal pattern having the high gamma and the low gamma corresponding to the plurality of sub-pixels for a time division configuration, a spatio-temporal pattern having the high gamma and the low gamma corresponding to the plurality of sub-pixels for a space and time division configuration, and to generate gamma data of a sub-pixel using at least two of the spatial pattern, the temporal pattern or the spatio-temporal pattern in a cascade configuration, a first gamma controller configured to generate first gamma data of the sub-pixel being high gamma data or low gamma data corresponding to image data of the sub-pixel based on a first preset pattern, which is preset to a first one among the spatial, temporal or spatio-temporal patterns, and a second gamma controller configured to generate second gamma data of the sub-pixel being high gamma data or low gamma data corresponding to the first gamma data of the sub-pixel based on a second preset pattern, which is preset to a second one among the spatial, temporal or spatio-temporal patterns; and a data driver configured to convert the first gamma data and the second gamma data to a data voltage and to output the data voltage to the data line.

2. The display apparatus of claim 1 wherein the data line and the gate line cross each other, and the matrix array is an m×n matrix where m and n are natural numbers.

3. The display apparatus of claim 1, at least one of the patterns further comprising at least a third gamma corresponding to the plurality of sub-pixels.

4. The display apparatus of claim 1, the gamma data generator further comprising:

a high gamma look-up table (LUT) configured to store high gamma data corresponding to grayscales based on the high gamma; and a low gamma LUT configured to store low gamma data corresponding to the grayscales based on the low gamma.

5. The display apparatus of claim 4, the gamma data generator further comprising:

at least a third gamma controller configured to generate at least third gamma data for the sub-pixel corresponding to the first and second gamma data of the sub-pixel based on at least a third preset to a third one among a spatial, temporal or spatio-temporal pattern.

6. The display apparatus of claim 4 wherein the second gamma data of the sub-pixel comprises first mixing gamma data, second mixing gamma data, third mixing gamma data and fourth mixing gamma data, the first mixing gamma data is generated using the high gamma LUT of the first preset pattern and the high gamma LUT of the second preset pattern in the cascade method;

the second mixing gamma data is generated using the high gamma LUT of the first preset pattern and the low gamma LUT of the second preset pattern in the cascade method;

the third mixing gamma data is generated using the low gamma LUT of the first preset pattern and the high gamma LUT of the second preset pattern in the cascade method; and the fourth mixing gamma data is generated using the low gamma LUT of the first preset pattern and the low gamma LUT of the second preset pattern in the cascade method.

7. The display apparatus of claim 4 wherein a number of mixing conditions of the first preset pattern and second preset pattern is at least 9.

8. The display apparatus of claim 4 wherein the temporal pattern, the spatial pattern and the spatio-temporal pattern respectively correspond to a plurality of sub-pixels arranged in a (2×2) matrix array.

9. The display apparatus of claim 4, further comprising:

a pattern detector configured to detect an image pattern of the image data, and to determine the first preset pattern and the second preset pattern based on the image pattern.

10. The display apparatus of claim 1 wherein the sub-pixel comprises a plurality of sub-areas where each of the plurality of sub-areas is individually driven.

11. A method of driving a display apparatus, which comprises a data line, a gate line and a sub-pixel connected between the data line and the gate line, the method comprising:

generating first gamma data and second gamma data of a sub-pixel using at least two of a spatial pattern, a temporal pattern or a spatio-temporal pattern in a cascade method, the spatial pattern having a high gamma and a low gamma corresponding to a plurality of sub-pixels arranged in a matrix array in a space division method, the temporal pattern having the high gamma and the low gamma corresponding to the plurality of sub-pixels in a time division method, and the spatio-temporal pattern having the high gamma and the low gamma corresponding to the plurality of sub-pixels in a space and time division method; and converting the gamma data to a data voltage as output to the data line, wherein the first gamma data of the sub-pixel comprises high gamma data or low gamma data corresponding to image data of the sub-pixel based on a first preset pattern, which is preset to a first one among the spatial, temporal or spatio-temporal patterns, and wherein the second gamma data of the sub-pixel comprises high gamma data or low gamma data corresponding to the first gamma data of the sub-pixel based on a second preset pattern, which is preset to a second one among the spatial, temporal or spatio-temporal patterns.

12. The method of claim 11, at least one of the patterns further comprising at least a third gamma corresponding to the plurality of sub-pixels.

13. The method of claim 11, further comprising:

generating third gamma data for the sub-pixel corresponding to the first and second gamma data of the sub-pixel based on a third preset pattern that is preset to a third one among spatial, temporal or spatio-temporal patterns.

14. The method of claim 11, further comprising:

generating gamma data of the sub-pixel using a high gamma look-up table (LUT), which is configured to store high gamma data corresponding to grayscales based on the high gamma, and a low gamma LUT, which is configured to store low gamma data corresponding to the grayscales based on the low gamma.

15. The method of claim 14 wherein the second gamma data of the sub-pixel comprises first mixing gamma data, second mixing gamma data, third mixing gamma data and fourth mixing gamma data, the first mixing gamma data is generated using the high gamma LUT of the first preset pattern and the high gamma LUT of the second preset pattern in the cascade method;

the second mixing gamma data is generated using the high gamma LUT of the first preset pattern and the low gamma LUT of the second preset pattern in the cascade method;

the third mixing gamma data is generated using the low gamma LUT of the first preset pattern and the high gamma LUT of the second preset pattern in the cascade method; and the fourth mixing gamma data is generated using the low gamma LUT of the first preset pattern and the low gamma LUT of the second preset pattern in the cascade method.

16. The method of claim 11, wherein a number of mixing conditions of the first preset pattern and second preset pattern is at least 9.

17. The method of claim 11, wherein the temporal pattern, the spatial pattern and the spatio-temporal pattern respectively correspond to a plurality of sub-pixels arranged in a (2×2) matrix array.

18. The method of claim 11, further comprising:

detecting an image pattern of the image data; and determining the first preset pattern and the second preset pattern corresponding to the image pattern.

19. The method of claim 11, wherein the sub-pixel comprises a plurality of sub-areas and each of the plurality of sub-areas is individually driven.

* * * * *